United States Patent [19]

Frick, Jr. et al.

[11] 4,353,707

[45] Oct. 12, 1982

[54] TEXTILE FINISHING AGENTS FROM REACTION PRODUCTS OF CARBAMATES AND GLUTARALDEHYDE

[75] Inventors: John G. Frick, Jr., New Orleans; Robert J. Harper, Jr., Metairie, both of La.

[73] Assignee: The United States of America as represented by the Secretary of Agriculture, Washington, D.C.

[21] Appl. No.: 302,007

[22] Filed: Sep. 15, 1981

[51] Int. Cl.[3] ..... D06M 13/34

[52] U.S. Cl. ..... 8/187; 8/194; 8/196; 8/DIG. 17

[58] Field of Search ..... 8/187, DIG. 17

[56] References Cited

U.S. PATENT DOCUMENTS

| | | | |
|---|---|---|---|
| 3,556,713 | 1/1971 | Kullman et al. | 8/187 |
| 3,897,208 | 7/1975 | Shay | 8/187 |
| 3,936,561 | 2/1976 | Cotton | 8/115.6 |
| 4,207,073 | 6/1980 | Petersen et al. | 8/187 |

FOREIGN PATENT DOCUMENTS 1107796 3/1968 United Kingdom .

OTHER PUBLICATIONS

Hurwitz, M. D. and Conlow, L. E., Textile Research Journal, 1958, 28, (No. 3), pp. 257–262.

Reid, J. D. et al., American Dyestuff Reporter, Jun. 1970, pp. 26–28, 32 and 34.

Walker, J. F., "Formaldehyde," (Amer. Chemical Soc. Monograph Series; Reinhold), 1953, p. 307.

*Primary Examiner*—A. Lionel Clingman

*Attorney, Agent, or Firm*—M. Howard Silverstein; David G. McConnell; Raymond C. Von Bodungen

[57] ABSTRACT

A finishing agent for fabrics containing cellulose that is free of formaldehyde is prepared from equimolar amounts of methyl carbamate and glutaraldehyde. The reaction product, although unstable in dilute aqueous solution, can be applied to fabric from concentrated aqueous solution or can be methylated for application from dilute solution. Fabric is given wrinkle-resistance and durable-press properties with no release of formaldehyde from the agent or from the treated fabric.

3 Claims, No Drawings

TEXTILE FINISHING AGENTS FROM REACTION PRODUCTS OF CARBAMATES AND GLUTARALDEHYDE

BACKGROUND OF THE INVENTION

1. Field of the Invention

The invention concerns a new treatment for fabric composed entirely or in part of cellulose to impart wrinkle-resistance and durable-press properties without release of formaldehyde.

2. Description of the Prior Art

Prior finishing treatments for cotton or other cellulosic fabric to impart wrinkle-resistance and the ability to dry smoothly have employed the products from the reaction of formaldehyde and an amide as finishing agents. These reaction products are methylol amides or hydroxymethyl amides. Example of these compounds are dimethylolurea, dimethylolethyleneurea, dihydroxydimethylolethyleneurea, and alkyl dimethylolcarbamates. These agents are applied to fabric with an acidic catalyst. The fabric is then heated, causing the methylol amide to react with two or more cellulose molecules and form crosslinks. The crosslinked cellulose makes a more resilient fiber than the untreated cellulose. The fiber is then less prone to suffer permanent deformations that appear in the fabric as wrinkles. To serve as a crosslinking agent, the finishing agent must possess two or more methylolamide groups in the molecular structure.

The methylol amides have been quite effective finishing agents for producing wrinkle-resistance. They do, however, suffer from a number of disadvantages. One disadvantage is that the agent and its reaction product on the fabric tend to decompose and release formaldehyde. Formaldehyde is very irritating and even small amounts are objectionable. It is also possible that even a small amount of free formaldehyde may be a health hazard.

To avoid the presence of formaldehyde the use of products from the reaction of other aldehydes and amides has been attempted. Only with glyoxal as the aldehyde replacing formaldehyde has the approach been useful, and even the agents prepared with glyoxal have not met with great success.

The problem in using other aldehydes with amides is the poor stability of the reaction product. The reaction of the aldehyde and amide to form an adduct is reversible. With most aldehydes the tendency for the adduct to decompose is great enough that a reaction mixture of aldehyde and amide gives a solution without enough adduct to be effective in treating fabric.

SUMMARY OF THE INVENTION

The instant invention is a process for imparting increased wrinkle-resistance to a cellulosic fabric without using materials made from formaldehyde. A reaction product is prepared from methyl carbamate and glutaraldehyde. The solution from this preparation is applied to fabric with an acidic metallic salt catalyst and then heated to cause reaction of the product under the influence of the catalyst.

DESCRIPTION OF THE PREFERRED EMBODIMENTS

The purpose of this invention is to provide a treatment for cotton fabric and other fabric composed entirely or in part of cellulose that will render the fabric resistant to wrinkling in use and in laundering and that will consist in applying a finishing agent or agents not made from formaldehyde. Therefore, there will be no release of formaldehyde from the treatment or treated fabric.

The finishing agents of this invention are reaction products of an alkyl monocarbamate, typified by methyl carbamate, and glutaraldehyde. The glutaraldehyde molecule contains two aldehyde groups at the terminals of a five carbon chain. Because of this size glutaraldehyde can react with an amide group to form an adduct containing a six-membered ring in which there are a nitrogen atom and five carbon atoms and on which there are two hydroxy groups on carbon atoms next to the nitrogen atom. These adducts are N-substituted-2,6-dihydroxypiperidines. The hydroxy groups in these compounds are as reactive as those in hydroxymethyl amides, the adducts from formaldehyde. And because of the stability conferred by the six-membered ring, these adducts are more stable than most amide-aldehyde adducts.

However, even with the additional stabilization, the adduct from methyl carbamate and glutaraldehyde decomposes readily in dilute aqueous solution. A chromatographic examination of a 4% solution shows the presence of the original carbamate and glutaraldehyde only, although spectroscopy of the concentrated reaction mixture shows that a reaction product is present. To avoid the decomposition on dilution the adduct from methyl carbamate and glutaraldehyde can be applied from concentrated solution or as a stable derivative from dilute solution.

Application of a concentrated solution could place an excessive and wasteful amount of agent on the fabric with ordinary methods of application, such as, immersion of the fabric in the solution and expression of excess solution by pad or squeeze rolls. There are, however, modified methods of application that apply less agent solution to the fabric. Some of these are described by R. J. Harper, Jr., Textile Chemist and Colorist 11 (6), 21-23,43 (1979). With these methods of application the increase of fabric weight by the solution can be 40% or less, and application of a solution concentrated enough to retain sufficient adduct is possible.

Alternatively, the adduct can be converted to the methyl ether, a N-substituted-2,6-dimethoxypiperidine, by treatment with acidified methanol. The ether is more stable than the hydroxy compound and can be applied by ordinary application methods with little loss of reactivity.

As is usual with the hydroxymethyl amides, or the methoxymethyl amides, the adducts from glutaraldehyde and a carbamate are applied to cotton or other cellulosic fabric with an acidic catalyst, ordinarily an acidic metal salt. The fabric is dried and then heated or cured. In curing, the agent reacts with cellulose forming ethers. Because there are two reactive groups in the adduct of glutaraldehyde and a carbamate, two of the polymeric cellulose molecules are bound by the reacted adduct to form the crosslink necessary for increased resiliency.

To prepare the finishing agents of this invention a monoalkyl carbamate, such as methyl carbamate, is mixed with an equimolar amount of glutaraldehyde in the minimum amount of water necessary to give a solution. Usually glutaraldehyde is obtained in water solution up to 50% concentration. With methyl carbamate the amount of water with 50% glutaraldehyde is sufficient to make a solution.

We have allowed the reaction of glutaraldehyde and carbamate to proceed at ordinary temperature although the temperature could be raised to shorten the reaction time. The reaction proceeds at pH 5.0 to pH 8.5; typically we have used pH 8.0. Ordinarily we have allowed four days for the reaction. However, a longer period does not give a less effective agent, and a shorter period may suffice.

The agent is applied to fabric in 10–20% of fabric weight with a metallic salt in 0.5–4.0% of fabric weight. Typically the salt is magnesium chloride hexahydrate in 1.5–2.0% of fabric weight. However, an appropriate amount of other salts, such as zinc nitrate or zinc fluoborate, may be used.

When the agent is to be applied from concentrated solution, the reaction mixture is diluted to a concentration that will deposit the proper amount of agent on the fabric with the amount of solution left on the fabric by the chosen method of application. For instance, when the solution will be applied to give a 40% weight gain to the fabric, the reaction mixture will be diluted to give a solution containing 30–50% agent based on the reagents used. The diluted solution is adjusted to about pH 5 and the metallic salt added before application to fabric.

When the agent is to be stabilized by methylation for application from a more diluted solution, the following procedure is used. The reaction mixture of carbamate and glutaraldehyde is evaporated, preferably under vacuum at 20°–50° C., to remove most of the water. The dried agent is dissolved in methanol to give a 10–30% solution. The solution is acidified with a strong acid, such as hydrochloric acid, and allowed to stand 15–30 minutes. The solution is then stirred with an alkaline material that has little solubility in methanol, such as sodium carbonate, until the acid is neutralized. The insoluble material is removed by filtration, and the filtrate evaporated to obtain the methylated adduct. For application to fabric the methylated adduct is dissolved in a suitable solvent, such as an alcohol-water mixture, to make a 12–25% solution. The solution is adjusted to pH 5 and an acidic metal salt added, such as magnesium chloride hexahydrate to make 1.5–2.0% of the solution. This solution is applied to fabric by ordinary means, such as by using pad rolls.

With either method of application the solution of agent can be mixed with auxillary agents commonly used in finishing textiles. These include materials for modifying the hand, strength or absorbency of the fabric.

After application of the agent, the fabric is dried and then heated at 150°–160° C. for 2–4 minutes. It is preferable to wash the fabric as a final part of the treatment to remove any unreacted materials.

With the described finishing treatment the fabric has increased resistance to wrinkling and maintains a smoother appearance during use and through laundering. Nevertheless, there is no evidence of formaldehyde odor during treatment or from the treated fabric.

In the following examples that illustrate the practice of this invention, all percentages are percent by weight. The test methods used to evaluate fabric properties are from the tests described by the American Association of Textile Chemists and Colorists in the 1979 Technical Manual of the AATCC.

EXAMPLE 1

Methyl carbamate, 330 g, was dissolved in 881 g of 50% glutaraldehyde solution. The solution was adjusted to pH 8 with 10% sodium hydroxide and allowed to stand. After four days the solution was adjusted to pH 5 with 5% hydrochloric acid, and 131 g of magnesium chloride hexahydrate dissolved in 131 g water was added. This solution of adduct from methyl carbamate and glutaraldehyde and magnesium chloride was applied to cotton printcloth to give a 38% weight gain using the transfer method described by R. J. Harper, Jr., Textile Chemist and Colorist 11(6), 21–23,43 (1979). In this method of application, the fabric to be treated is passed between pad rolls with another fabric that has been wet with the solution of finishing agent so that a portion of the solution is transferred to the fabric to be treated.

The impregnated printcloth is dried for 5 minutes at 70° C. and cured for 3 minutes at 160° C. in mechanical convection ovens. The fabric is then washed. This treated fabric had wrinkle recovery angles of 128° and 132° in warp and filling directions and a durable-press rating of 3.4. The untreated fabric had wrinkle recovery angles of 83° and 87° and a durable press rating of 1.6.

EXAMPLE 2

A methylated adduct of methyl carbamate and glutaraldehyde was prepared as follows: Methyl carbamate, 15 g, was dissolved in 40 g of 50% glutaraldehyde solution. The solution was adjusted to pH 8 and allowed to stand six days. The solution was then concentrated under vacuum without heating to 36 g of a viscous liquid. This liquid was soluble in water and methanol but insoluble in toluene.

The liquid was dissolved in 250 ml of methanol. This solution was acidified by adding five drops of 37% hydrochloric acid. After 20 minutes, two grams of anhydrous sodium carbonate were added. The mixture was stirred until the liquid phase was neutral and then filtered. The filtrate was evaporated under vacuum to 40 g of methylated adduct. The methylated adduct was a liquid that was soluble in methanol and toluene but poorly soluble in water.

EXAMPLE 3

The methylated adduct of Example 2 was applied to fabric in the following manner. A 12.4 g portion of the methylated adduct was dissolved in a mixture of 45 g ethanol and 29 g water. The solution was adjusted to pH 5 and 1.8 g magnesium chloride hexahydrate dissolved in 1.8 g water was added. The solution was applied to cotton printcloth by saturating the fabric with the solution and then passing the fabric between pad rolls to leave 80–90% weight gain. The fabric was dried for 7 minutes at 70° C. and cured 3 minutes at 160° C. in mechanical convection ovens. The fabric was then washed. This treated fabric had wrinkle recovery angles of 121° and 116° in the warp and filling directions and a durable-press rating of 3.2.

We claim:

1. A process for imparting increased wrinkle-resistance to a cellulosic fabric without using materials made from formaldehyde by:

(a) preparing a reaction product from methyl carbamate and glutaraldehyde;

(b) applying the product in concentrated solution to fabric with an acidic metallic salt catalyst; and (c) heating the fabric to cause reaction of the product under the influence of the catalyst.

2. The process of claim 1 including methylating the product of step (a) with acidified methanol, applying a solution of the methylated product to fabrics with an acidic metallic salt catalyst; and then following with step (c).

3. The process of claim 2 wherein the catalyst is magnesium chloride hexahydrate.

* * * * *